US005533337A

United States Patent [19]

Kusayama

[11] Patent Number: 5,533,337

[45] Date of Patent: Jul. 9, 1996

[54] FEED WATER SUPPLY SYSTEM OF POWER PLANT

[75] Inventor: Yosio Kusayama, Toukai-mura, Japan

[73] Assignee: Hitachi, Ltd., Tokyo, Japan

[21] Appl. No.: 279,119

[22] Filed: Jul. 22, 1994

[30] Foreign Application Priority Data

Jul. 23, 1993 [JP] Japan ..... 5-182425

[51] Int. Cl.[6] ..... F01R 13/02

[52] U.S. Cl. ..... 60/656; 60/646; 60/657

[58] Field of Search ..... 60/656, 657, 646, 60/677

[56] References Cited

U.S. PATENT DOCUMENTS 3,068,653 12/1962 Driscoll .
3,972,196 8/1976 Silvestri, Jr. ..... 60/670
4,087,860 5/1978 Beatty et al. ..... 60/656

FOREIGN PATENT DOCUMENTS 62-37603 2/1987 Japan .
63-99403 4/1988 Japan .

*Primary Examiner*—Denise L. Gromada
*Assistant Examiner*—Alfred Basichas
*Attorney, Agent, or Firm*—Antonelli, Terry, Stout & Kraus

[57] ABSTRACT

In a feed water supply system for a power plant, feed water is supplied into a steam generator to generate steam, the steam is fed to a main turbine to drive an electric generator, and a feed water pump for supplying feed water into the steam generator is arranged so as to be driven by a feed water pump turbine driven with steam. The system is provided with main turbine extraction steam pipings for passage of main turbine extraction steam, high pressure auxiliary steam pipings for passage of high pressure steam, and low pressure auxiliary steam pipings for passage of low pressure steam, as pipings for steam supply for driving the feed water pump turbine. The feed water pump turbine is driven at a time of normal starting of the plant through switching from the low pressure auxiliary steam pipings to the main turbine extraction steam pipings, and the feed water pump turbine is driven at a time of rapid restarting of the plant after stopping of the electric generator through switching from the high pressure auxiliary steam pipings to the main turbine extraction steam pipings.

3 Claims, 3 Drawing Sheets

FEED WATER SUPPLY SYSTEM OF POWER PLANT

BACKGROUND OF THE INVENTION

The present invention relates to a feed water supply system for a power plant and, more particularly, to a power plant feed water supply system which supplies feed water into a steam generator, using a turbine driven feed water pump.

A conventional feed water supply system for a power plant has a motor driven feed water pump and a turbine driven feed water pump arranged in parallel with each other, which pumps are changed over according to operation conditions, etc. to supply feed water into a steam generator.

For this kind of use, several methods are known for the case of plant starting, for example. One of them is a method in which a motor driven feed water pump is used at an initial stage of starting to supply feed water into a steam generator, and then a turbine driven feed water pump is driven by utilizing extraction-steam from a main steam turbine after steam is generated in the steam generator. Another is a method in which an auxiliary steam source is provided in advance, a turbine driven feed water pump is used from an initial stage of starting to supply feed water into the steam generator, and the turbine driven feed water pump is driven by using extraction steam from a main steam turbine after generation of steam in the steam generator.

Further, a method in which the turbine driven feed water pump is driven with an auxiliary steam source is disclosed in JP A 62-37603 (1987) and JP A 63-99403 (1988), wherein, when an accident occurs on electric transmitting wires and the load of the power plant is reduced to continue operation (so-called, FCB operation), the operation is continued by switching steam to be supplied to a feed water pump turbine from the main turbine extraction steam used at normal operation to auxiliary steam. In particular, in this case, it is suggested that the pressure of the auxiliary steam is changed according to operation conditions.

In the usual power plant, in many cases, two 50% capacity turbine driven feed water pumps and a 25–30% capacity motor driven feed water pump are employed. However, since the motor driven feed water pump is provided inherently as an auxiliary apparatus or a starting apparatus, recently, in many cases, it has been proposed to use a method in which the turbine driven feed water pump is used as much as possible, under ordinary operating conditions, including plant starting and stopping.

However, as to whether or not it is possible to operate only a turbine driven feed water pump under any operational conditions, the answer is no, that is, there are several exceptions. For example, when a boiler is brought into a trip condition due to load interruption, etc., the boiler and turbine metal attain high temperature conditions before the load interruption; however, in case a once through boiler is being used, since the feed water pump for supplying feed water to the boiler is stopped, it must be restarted by using a motor driven feed water pump.

A more detailed explanation will be given. In the case of normal starting, the inner pressure of the boiler is zero or several tens of kg/cm$^2$, for example, and in order to supply feed water to the boiler by a feed water pump, it is sufficient for the driving steam pressure of the feed water pump turbine to be several kg/cm$^2$ or so in general, and usually, driving steam of about this pressure value is used. On the contrary, since the inner pressure of the boiler at restarting after a boiler trip remains more than two hundred kg/cm$^2$ in case of a super critical pressure once through boiler, in order to secure feed water at the restarting using a turbine driven feed water pump, it is necessary for a drive steam pressure of the feed water pump turbine to be several kg/cm$^2$ to several tens of kg/cm$^2$ in general.

Here, as the driving steam of the feed water pump turbine, auxiliary steam which is provided in advance or turbine extraction steam is used. The former steam is used at starting and the latter steam is switched during normal operation. Further, operation using the main turbine extraction steam during normal operation is effective from the point of view of an improvement in a plant efficiency, and the extraction steam changes in proportion to the load of the main turbine within a range from 0 kg/cm$^2$ to several kg/cm$^2$.

As apparent from the above explanation, in the case of an operation using a boiler feed water pump, including restarting after the boiler trip, it is necessary to provide auxiliary steam at a pressure of several kg/cm$^2$ to several tens of kg/cm$^2$ for driving the feed water pump turbine. This causes the turbine efficiency to worsen because, when the steam is changed to the turbine extraction steam, the main turbine extraction steam does not enter the feed water pump turbine, since the auxiliary steam pressure is higher than the main turbine extraction steam pressure, and the operational range of the feed water pump turbine using extraction steam is narrow.

On the contrary, when importance is attached to the plant efficiency and the auxiliary steam pressure is set to a necessary, but minimum, pressure value (usually, 2 kg/cm$^2$ or so), it is impossible to use the feed water pump at the restarting after boiler trip to supply feed water, and it is necessary to use a motor driven feed water pump.

SUMMARY OF THE INVENTION

From the above-mentioned, an object of the present invention is to provide a feed water supply system for a power plant, in which plant operation by a turbine driven feed water pump can be made possible to the utmost and the operation efficiency is high.

The present invention to achieve the above-mentioned object resides in a feed water supply system of a power plant in which feed water is supplied into a steam generator to generate steam, the steam is fed to a main turbine to drive an electric generator, and a feed water pump for supplying feed water into the steam generator is provided so as to be driven by a feed water pump turbine driven with steam, wherein main turbine extraction steam pipings for passage of main turbine extraction steam, high pressure auxiliary steam pipings for passage of high pressure steam, and low pressure auxiliary steam pipings for passage of low pressure steam are provided as pipings for steam supply for driving the feed water pump turbine. The feed water pump turbine is driven at a time of normal starting of the plant through switching from the low pressure auxiliary steam pipings to the main turbine extraction steam pipings, and the feed water pump turbine is driven at a time of rapid restarting of the plant after stopping of the electric generator through switching from the high pressure auxiliary steam pipings to the main turbine extraction steam pipings.

According to the present invention, at a time of ordinary starting, first, the feed water pump turbine is driven with steam from the low pressure auxiliary steam pipings, and then, the feed water pump turbine is driven by switching it to the main turbine extraction steam pipings, so that the plant can be operated by the feed water pump turbine over the entire range of operation from start to stop. Further, at a time of rapid restarting after stopping of the electric generator, since the feed water pump turbine is driven with high pressure steam supplied from the high pressure auxiliary steam pipings, even if the remaining pressure in the boiler is high, it is possible to supply feed water in the boiler under a smooth control; and after that, since the feed water pump turbine is driven from the main turbine extraction steam pipings, it is possible to operate the plant at high efficiency as a whole.

DESCRIPTION OF THE EMBODIMENTS OF THE INVENTION

Figure 2:
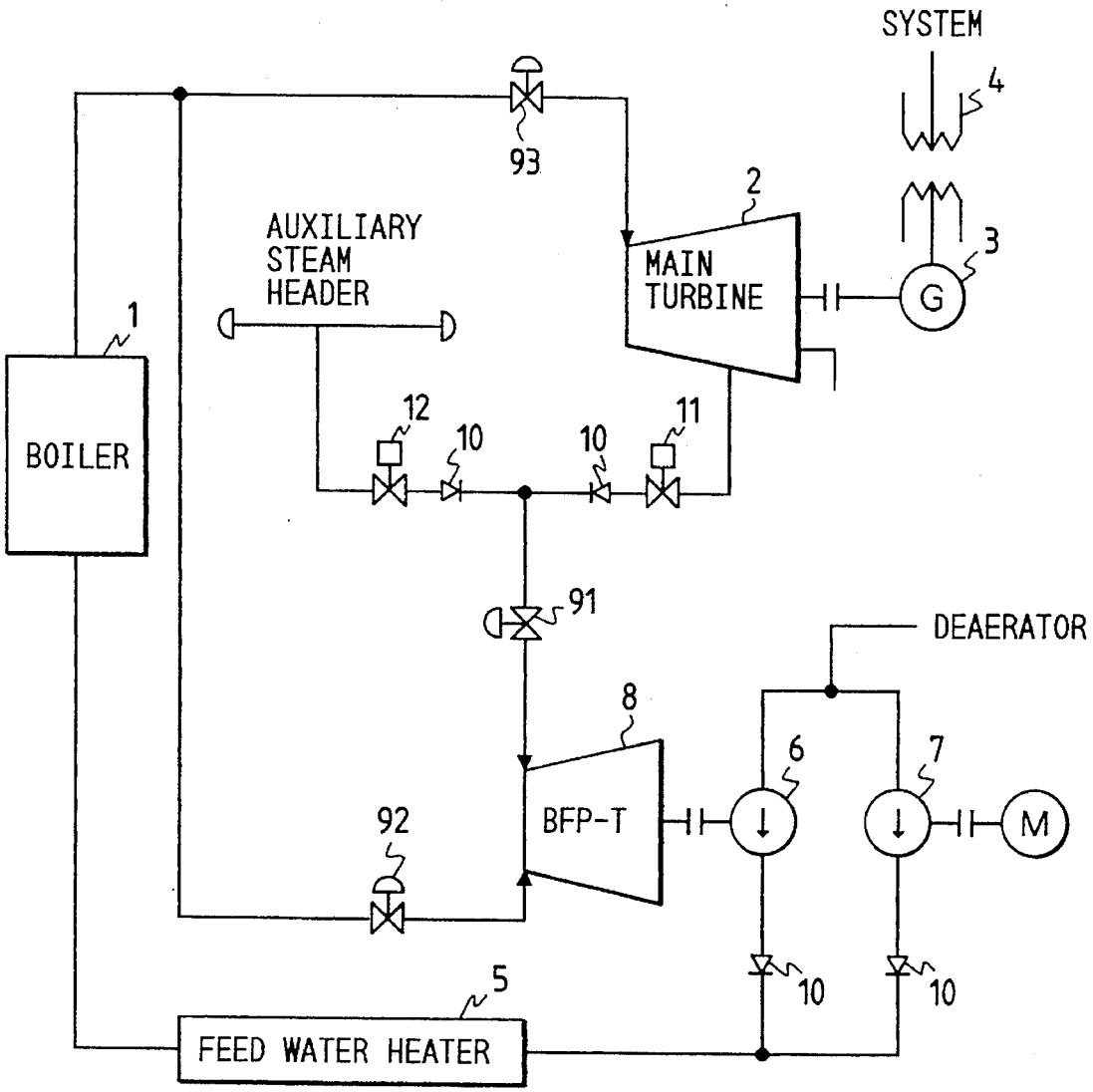
FIG. 2 is a schematic diagram of a system around a boiler feed water pump turbine for a power plant.

A general feed water system construction for a power plant is shown in FIG. 2. In FIG. 2, a reference number 1 designates a boiler; a reference numeral 2 designates a main steam turbine for power generation; a reference number 3 designates a generator; a reference number 4 designates a transformer; a reference number 5 designates a feed water heater for heating feed water supplied to the boiler 1; a reference number 6 designates a turbine driven boiler feed water pump; a reference number 7 designates a motor driven boiler feed water pump; a reference number 8 designates a boiler feed water pump turbine (BFP-T); reference numbers 91, 92, 93 designate steam regulation valves for control of the quantity of steam flowing into the turbine 2 or 8; a reference number 10 designates a check valve; a reference number 11 designates an interruption valve for main turbine extraction steam; and a reference number 12 designates an interruption valve for auxiliary steam.

The feed water system is constructed, as seen in this figure, so that feed water from the turbine driven boiler feed water pump 6 or the motor driven boiler feed water pump 7 is supplied into the boiler 1 through the feed water heater 5 to generate steam there. The steam generated in the boiler 1 is supplied into the main turbine 2 through the steam regulation valve 93. Electric power generated by driving the generator 3 is transmitted to an electric power system through the transformer 4.

The boiler feed water pump turbine 8 is driven by three kinds of steam in this figure. One of them is main turbine extraction steam flowing in the turbine 8 through the interruption valve 11, which steam is used during ordinary operation. When an accident occurs on the side of the main turbine 2, the steam regulation valve 93 is closed, and the boiler feed water pump turbine 8 is no longer supplied with the main turbine extraction steam. Under this condition, the boiler feed water turbine 8 is directly supplied with a high pressure steam from the boiler 1 through the steam interruption valve 92 and is driven thereby. The steam supply through those two steam lines is necessary for the boiler 1 and the main turbine 2 to be operated. An auxiliary steam source, however, is prepared for use in starting, etc. in which the lines can not function, and the steam of the auxiliary steam source is introduced into the boiler feed water pump turbine 8 through the steam interruption valve 12.

Figure 1:
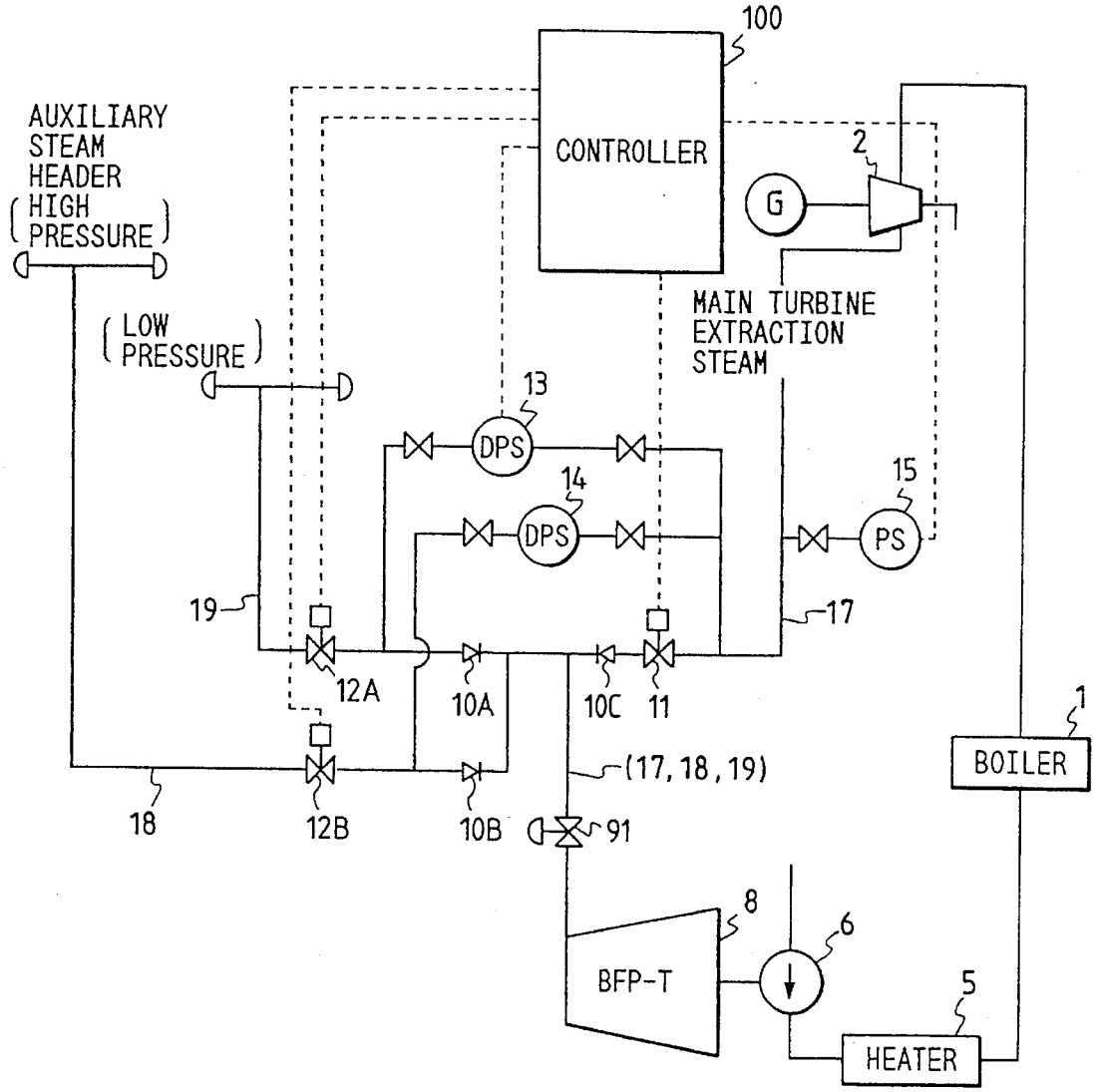
FIG. 1 is a schematic diagram of a first embodiment of the present invention.

FIG. 1 shows a first embodiment of a system construction around a boiler feed water pump turbine (referred to as BFP-T hereunder) of the present invention. In FIG. 1, a part or apparatus, designated by the same reference number as in FIG. 2 is the same part or apparatus, or one having the same function. Further, in FIG. 1, a reference number 15 designates a main turbine extraction steam pressure switch; reference numbers 13, 14 designates a differential pressure switch; and a reference number 100 designates a drive steam pressure control apparatus. Piping 17 provides a steam passage for main turbine extraction steam from the main turbine 2 to the boiler feed water pump turbine 8, and the valves 11 and 91 are mounted in the steam passage to control the steam flow therein. Pipings 18 provides steam passage for high pressure auxiliary steam from a high pressure auxiliary steam source to the boiler feed water pump turbine 8, and the valves 12B and 91 are mounted on the steam passage to control the steam flow therein. Piping 19 provides a steam passage for low pressure auxiliary steam from a low pressure auxiliary steam source to the boiler feed water pump turbine 8, and the valves 12A and 91 are mounted in the steam passage to control the steam flow therein.

As shown in FIG. 1, a power plant feed water supply system according to the present invention is constructed so that the BFP-T 8 can be supplied with steam from a plurality of auxiliary steam sources, and opening and closing operations of the steam interruption valves 11, 12A, 12B and the steam regulation valve 91 under each operation condition are as indicated in the following table 1:

TABLE 1

| Plant operation mode | | Valve operation conditions 12A | 12B | 11 | 91 |
|---|---|---|---|---|---|
| At start. | Ordinary Start | open | closed | closed | open |
| | Restart after trip | closed | open | closed | open |
| | Load more than rated value | open or closed | closed | open | open |
| Ordinary operation | Load more than rated value | open or closed | closed | open | open |
| | Load less than rated value | open | closed | closed | open |
| At stop | Load less than rated value | open | closed | closed | open |

At a time of normal starting of the plant:

The inside of the boiler is in a zero or low remaining pressure condition, from which the BFP-T 8 is operated by opening the low pressure auxiliary steam interruption valve 12A, closing the main turbine extraction steam interruption valve 11 and the high pressure auxiliary steam interruption valve 12B, and controlling the steam regulation valve 91 to start the supply of feed water into the boiler. After firing of the boiler, when the main turbine is driven and reaches such a load that the extraction steam pressure which is able to operate the BFP-T 8 can be secured, the main turbine extraction steam is introduced into the BFP-T 8 as a drive steam source thereof by opening the main turbine extraction steam interruption valve 11 and closing the low pressure auxiliary steam interruption valve 12A. Here, as the conditions for opening the main turbine extraction steam interruption valve 11, it is effective to use the conditions of the main turbine extraction steam pressure switch 15 or the differential pressure switch 13.

At a time of rapid starting of the plant:

In case the boiler has tripped during operation of the plant due to load interruption, etc., the feed water pump also stops.

However, rapid restarting of the plant is possible by purging the boiler, supplying it with feed water within about 30 minutes and firing it. In this case, the boiler remaining pressure is more than 200 kg/cm$^2$ ( at ordinary starting, within 70 kg/cm$^2$) in case of a super-critical pressure boiler, and the shaft power of the BFP-T 8 becomes about twice. Therefore, when low pressure auxiliary steam is used for driving the BFP-T 8, the steam regulation valve 91 becomes fully open or nearly fully open, so that operation becomes difficult. Therefore, in case of restarting of the plant after such a trip of the boiler, the auxiliary steam interruption valve 12B is opened, the auxiliary steam interruption valve 12A is closed, the main turbine extraction steam interruption valve 11 is closed and the steam regulation valve 91 is controlled, whereby high pressure auxiliary steam is introduced into the BFP-T 8 to start the operation thereof, and feed water is supplied into the boiler.

Under this condition, when the main turbine is driven by the generated steam and reaches to such a load that the extraction steam pressure which is able to operate the BFP-T 8 can be secured, the main turbine extraction steam interruption valve 11 is opened to introduce the steam into the BFP-T 8 as a drive steam source thereof. In this case, however, since the auxiliary steam interruption valve 12B is opened, high pressure auxiliary steam pressure from the interruption valve 12B is higher than the main turbine extraction steam pressure from the main turbine extraction steam interruption valve 11. Under this condition, even if the main turbine extraction steam interruption valve 11 is opened, the main turbine extraction steam is not introduced into the BFP-T 8. Therefore, the high pressure auxiliary steam interruption valve 12 B is closed by using the plant load or the main turbine extraction steam pressure switch 15 or the differential pressure switch 14. Further, in this case, the low pressure auxiliary steam interruption valve 12A can be opened.

The above control is executed by the boiler feed water pump turbine drive steam pressure control apparatus 100 for controlling steam pressure driving the BFP-T 8, but judgment for effecting a restarting mode (a plant or boiler operation mode is a very hot start mode), after a boiler trip, is carried out by detecting the boiler remaining pressure at a time of restarting, the boiler remaining fluid temperature, or that a boiler trip relay is memorized to be operated once and reset within a certain time.

Further, it is possible during the ordinary operation to operate through suitable switching according to the magnitude of the load. It is better to drive the BFP-T 8 by using the main turbine extraction steam interruption valve 11 in a time of high load operation and by using the low auxiliary steam interruption valve 12A in a time of low load operation and at a time of stopping of plant operation.

Figure 3:
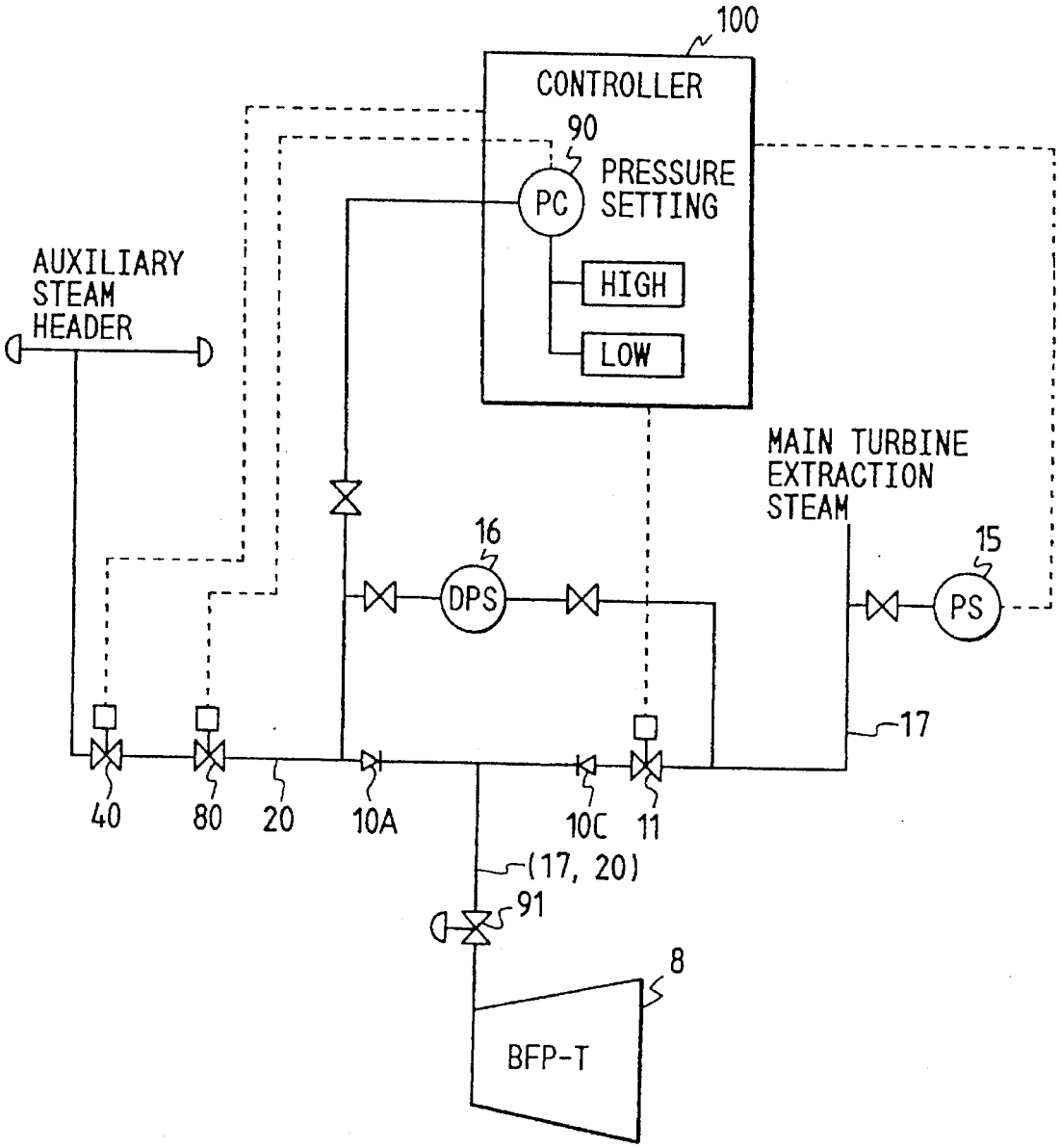
FIG. 3 is a schematic diagram of a second embodiment of the present invention.

Next, a second embodiment of the present invention will be explained using FIG. 3 and table 2. In FIG. 3, a reference number 40 designates an auxiliary steam interruption valve; a reference number 15 designates a main turbine extraction steam pressure switch; a reference number 16 designates a differential pressure switch; a reference number 80 designates an auxiliary steam pressure control valve; and a reference number 90 designates an auxiliary steam pressure controller. The piping 17 is the same as in FIG. 1. Piping 20 provides a steam passage for auxiliary steam from an auxiliary steam source to the boiler feed water pump turbine 8, and the valves 40, 80 and 91 are mounted in the steam passage to control the steam flow and the steam pressure therein. The following table 2 shows the operation of each valve and the set pressure of the auxiliary steam pressure controller 90.

TABLE 2

| Plant operation mode | | Controller set and Valve operation conditions | | | |
|---|---|---|---|---|---|
| | | 90 | 40 | 11 | 91 |
| At start. | Ordinary Start | low set | open | closed | open |
| | Restart after trip | high set | open | closed | open |
| | Load more than rated value | low set | open or closed | open | open |
| Ordinary operation | Load more than rated value | low set | open or closed | open | open |
| | Load less than rated value | low set | open | closed | open |
| At stop | Load less than rated value | low set | open | closed | open |

First of all, at the time of ordinary starting of the plant, since the boiler pressure is zero or a low remaining pressure, the set pressure of the auxiliary steam pressure controller 90 is set to a low set pressure (pressure at ordinary starting), the auxiliary steam interruption valve 40 is opened and the steam regulation valve 91 is controlled, whereby the BFP-T 8 is operated to start the supply of feed water into the boiler.

After the boiler is fired, the main turbine is started, and when the main turbine reaches such a load that the extraction steam pressure which is able to operate the BFP-T 8 can be secured, the main turbine extraction steam interruption valve 11 is opened; and the steam is introduced into the BFP-T 8 as a drive steam source thereof. Here, as the condition that the main turbine extraction steam interruption valve 11 is opened, it also is possible to use the condition of the main turbine extraction steam pressure switch 15 or the differential pressure switch 16.

Next, in case the boiler has been tripped by the interruption valves during operation of the plant, as described in detail in the first embodiment, the shaft power of the BFP-T 8 increases about twice, and so it becomes impossible to operate the BFP-T 8 by low pressure auxiliary steam since the steam regulation valve 91 will have to be fully open or nearly fully open. Therefore, in such restarting after a boiler trip, the set pressure of the auxiliary steam pressure controller 90 is set to a high set pressure (pressure at restarting) and the BFP-T 8 is operated.

Under this condition, the plant is restarted. When the main turbine is started and reaches such a load that extraction steam pressure which can operate the BFP-T 8 can be secured, the main turbine extraction steam interruption valve 11 is opened, and the main turbine extraction steam is introduced into the BFP-T 8 as a drive steam source thereof. However, in this case, since the set pressure of the auxiliary steam pressure controller 90 is set to the high set pressure, under this condition even if the main turbine extraction steam interruption valve 11 is opened, the steam is not introduced, so that the plant load set or the set pressure of the auxiliary steam controller 90, is changed over to a low pressure set by use of the main turbine extraction steam pressure switch 15 or the differential pressure switch 16. After that, it is sufficient for the auxiliary steam interruption valve 40 to be open or closed.

The relation between the BFP-T 8 and the turbine driven feed water pump is the same as in the first embodiment.

The above control is executed by the boiler feed water pump turbine drive steam pressure control apparatus 100, which is shared suitably in function. Further, a judgment method for a restarting mode after boiler trip in the second embodiment is the same as the method of the first embodiment.

The first and second embodiments are explained above, however, in any of the embodiments, gradual opening and gradual closing are necessary during a switching or change-over process. However, an thereof is omitted.

According to the present invention, even at the time of rapid restarting after boiler trip due to load interruption, etc., restarting of the plant is possible by the turbine driven feed water pump, and in full operation mode of the plant, including the occurrence of an accident, the plant is operated by the turbine driven feed water pump.

What is claimed is:

1. A feed water supply system for a power plant in which feed water is supplied into a steam generator to generate steam, the steam is fed to a main turbine to drive an electric generator, and a feed water pump for supplying feed water into the steam generator is arranged so as to be driven by a feed water pump turbine driven with steam, said feed water supply system comprising main turbine extraction steam pipings for passage of main turbine extraction steam, high pressure auxiliary steam pipings for passage of high pressure steam, and low pressure auxiliary steam pipings for passage of low pressure steam for steam supply for driving said feed water pump turbine, and means for switching the driving of said feed water pump turbine at a time of normal starting of the plant from said low pressure auxiliary steam pipings to said main turbine extraction steam pipings, and for switching the driving said feed water pump turbine at a time of rapid restarting of the plant after stopping of said electric generator from said high pressure auxiliary steam pipings to said main turbine extraction steam pipings.

2. A feed water supply system for a power plant in which feed water is supplied into a steam generator to generate steam, the steam is fed to a main turbine to drive an electric generator, and a feed water pump for supplying feed water into the steam generator is arranged so as to be driven by a feed water pump turbine driven with steam, said feed water supply system comprising main turbine extraction steam pipings, for passage of main turbine extraction steam, and high pressure auxiliary steam pipings, having a regulation valve, for passage of high or low pressure steam, for steam supply for driving said feed water pump turbine; means, operating at a time of ordinary starting of the plant, for setting said regulation valve for passage of low pressure steam and to switch driving of said feed water pump turbine from low pressure steam from said high pressure auxiliary steam pipings to said main turbine extraction steam pipings and said means, operating at a time of rapid restarting after stopping of said electric generator for setting said regulation valve for passage of high pressure steam from said high pressure auxiliary steam pipings and for switching driving of said feed water pump turbine to said main turbine extraction steam pipings from said high pressure auxiliary steam pipings.

3. A feed water supply system according to claim 2, wherein said means, operating at said time of rapid restarting after stopping of said electric generator, controls said regulation valve to switch from passage of high pressure steam to low pressure steam from said high pressure auxiliary steam pipings before switching driving of said feed water pump turbine to said main turbine extraction steam pipings.

* * * * *